US006623369B1

(12) United States Patent
Shea

(10) Patent No.: US 6,623,369 B1
(45) Date of Patent: Sep. 23, 2003

(54) BOWLING CENTER

(76) Inventor: Michael J. Shea, 1726 Creek Crossing Rd., Vienna, VA (US) 22182

( * ) Notice: Subject to any disclaimer, the term of this patent is extended or adjusted under 35 U.S.C. 154(b) by 0 days.

(21) Appl. No.: 09/561,928

(22) Filed: May 1, 2000

(51) Int. Cl.[7] ..... A63D 1/00
(52) U.S. Cl. ..... 473/57; 473/65; 463/43
(58) Field of Search ..... 463/1, 23, 43; 473/54, 57, 64, 65, 67, 73, 70, 71

(56) References Cited

U.S. PATENT DOCUMENTS

| | | | | |
|---|---|---|---|---|
| RE30,467 E | | 12/1980 | House et al. | 364/411 |
| RE30,471 E | | 1/1981 | Reynolds | 273/54 |
| 4,302,010 A | | 11/1981 | Kaenel | 273/54 C |
| 4,754,967 A | * | 7/1988 | Edler et al. | |
| 4,824,109 A | | 4/1989 | Cervantes | 273/54 |
| 5,083,271 A | * | 1/1992 | Thacher et al. | |
| 5,101,354 A | | 3/1992 | Mowers et al. | 364/410 |
| 5,118,105 A | * | 6/1992 | Brim et al. | |
| 5,198,976 A | | 3/1993 | Form et al. | 364/410 |
| 5,241,379 A | * | 8/1993 | Tsujita | |
| 5,450,318 A | | 9/1995 | Mowers et al. | 364/410 |
| 5,618,238 A | | 4/1997 | Kruse et al. | 473/70 |
| 5,628,693 A | | 5/1997 | Mowers et al. | 473/86 |
| 5,683,080 A | | 11/1997 | Vaioli et al. | 473/69 |
| 5,709,607 A | * | 1/1998 | Mowers et al. | |
| 5,719,548 A | | 2/1998 | Stirling et al. | 340/323 B |
| 5,842,929 A | | 12/1998 | Moody et al. | 473/70 |
| 5,857,912 A | | 1/1999 | Freitag | 463/42 |
| 5,970,143 A | | 10/1999 | Schneier et al. | |
| 6,015,344 A | | 1/2000 | Kelly et al. | |
| 6,304,789 B1 | | 10/2001 | Shea | |
| 6,322,365 B1 | | 11/2001 | Shechter et al. | |

FOREIGN PATENT DOCUMENTS

| | | |
|---|---|---|
| WO | WO 00/76610 | 12/2000 |

* cited by examiner

*Primary Examiner*—William M. Pierce

(57) ABSTRACT

A bowling center system includes a pinsetter for setting pins on a bowling lane. A control circuit controls the pinsetter to re-set a configuration of pins on the bowling lane based on performance data of a bowler if the bowler fails to knock down all the pins of the configuration.

29 Claims, 8 Drawing Sheets

BOWLING CENTER

TECHNICAL FIELD

The present invention generally relates to a bowling center and, more particularly, to a bowling center configured for practice bowling and other enhanced features.

BACKGROUND AND SUMMARY OF THE INVENTION

As described in U.S. Pat. No. 3,738,652, the game of bowling consists of ten turns, or "frames", for each bowler. A bowler is allowed to bowl two balls to complete a frame, although if the first ball knocks down all ten pins, the frame is completed and the bowler is credited with a "strike." If any pins are left standing after the first ball, the bowler bowls the second ball and if the bowler knocks down all of the remaining pins, the bowler is credited with a "spare." The bowler's score in a frame is the number of pins knocked down plus a bonus if all of the pins are knocked down in a frame. The bonus for a strike is the total number of pins knocked down by the next two balls bowled in the succeeding frame or frames; thus a strike counts 10 plus the total number of pins knocked down by the next two balls bowled by that bowler. The bonus for a spare is the number of pins knocked down by the first ball in the next frame. If a spare or a strike is made in the tenth (last) frame, the bowler is allowed to bowl an extra one or two balls, respectively, to complete his/her score.

In order to improve their scores, bowlers sometimes bowl practice games. While these practice games may lead to improvement, they generally do not provide a structured environment designed to improve the specific weaknesses of particular bowlers. The systems and methods described in this application provide such a structured environment. For example, as mentioned above, if a bowler fails to knock-down all the pins with the first ball of a frame, the bowler rolls a second ball in an attempt to knock down the remaining pins. In accordance with one aspect of the systems and methods described in this application, a record is maintained of a bowler's successes/failures at knocking down particular configurations of pins with the second balls of frames. This record is used to control a pinsetter during practice sessions or practice games. For example, if during a practice game a bowler fails to knock down all the pins of a particular pin configuration with the second ball of a frame, the pinsetter is controlled to reset that pin configuration to provide the bowler with one or more opportunities to again attempt to knock down all the pins of.that pin configuration. Whether a particular pin configuration is reset may be determined in accordance with various factors including, but not limited to, the bowler's previous successes/failures at knocking down all the pins of that configuration; the bowler's previous successes/failures at knocking down all the pins of that configuration relative to the successes/failures of other bowlers of similar skill levels; the price paid for practice game; etc.

The record of a bowler's successes/failures at knocking down particular pin configurations with the second balls of frames may also be used to generate a practice session for the bowler in which a pinsetter is controlled to set various pin configurations that the bowler attempts to knock down. This record may also be used to reward bowlers for knocking down all the pins of a particular configuration (e.g., as part of a contest) or to provide targeted advertising.

The accompanying drawings, which are incorporated in and constitute a part of the specification, illustrate various embodiments of the present invention and, together with the general description given above and the detailed description provided below, serve to explain the principles of the invention.

DETAILED DESCRIPTION

The present invention is described in the context of exemplary embodiments. However, the scope of the invention is not limited to the particular examples and embodiments described in this specification. Rather the description merely reflects certain embodiments and serves to illustrate the principles and characteristics of the present invention. Those skilled in the art will recognize that various modifications and refinements may be made without departing from the spirit and scope of the invention.

Figure 1:
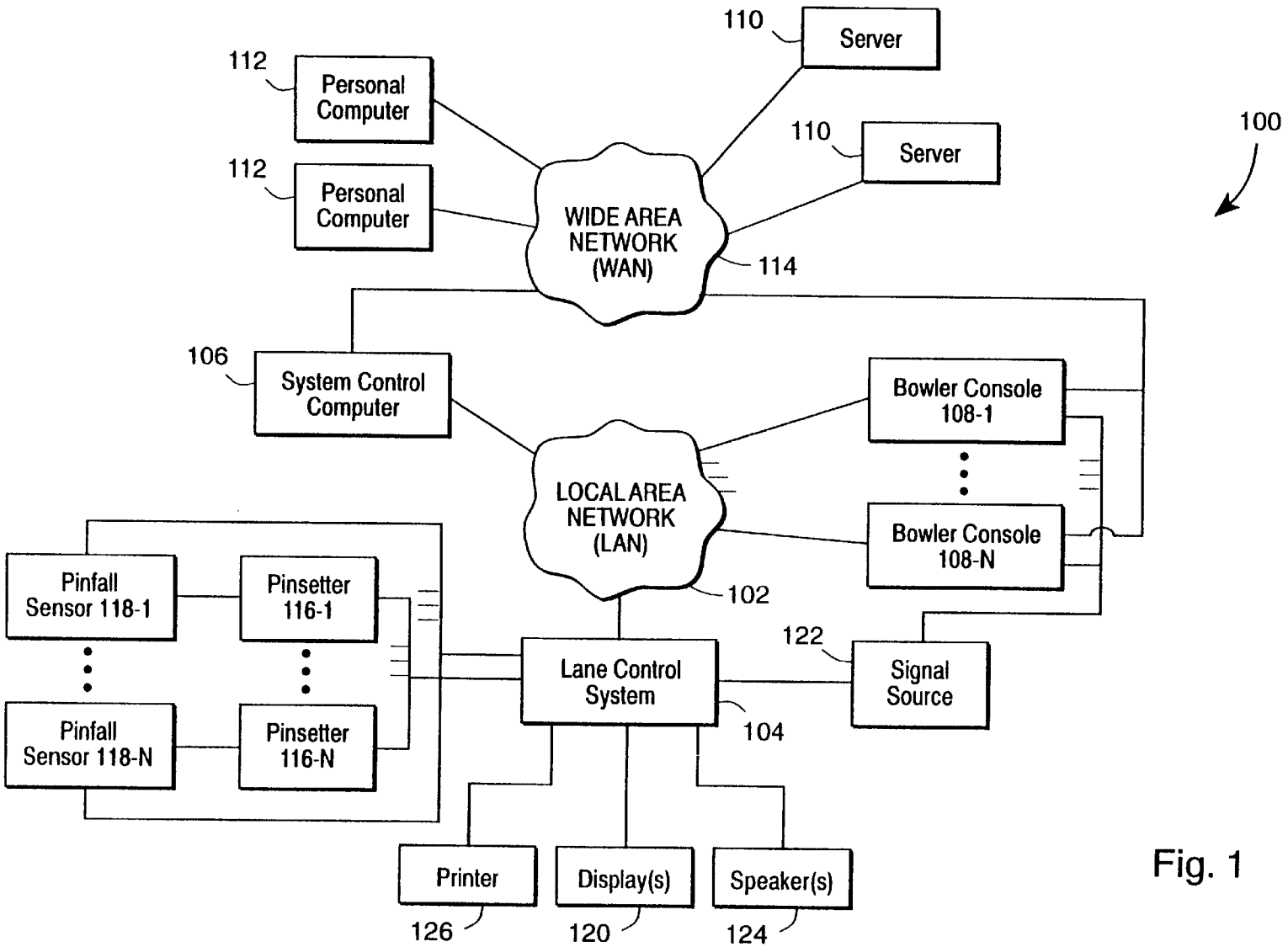
FIG. 1 is a generalized diagram of a system in accordance with an embodiment of the present invention.

FIG. 1 is a generalized diagram of a system 100 in accordance with an embodiment of the present invention. System 100 includes a local area network (LAN) 102 that interconnects a lane control system 104, a system control computer 106, and bowler consoles 108-1 to 108-N. As will be described in greater detailed below, one or both of system control computer 106 and the bowler consoles 108 are configured for communication with remote servers 110 (e.g., web servers) and personal computers 112 over a wide area network (WAN) 114 such as the Internet. Lane control system 104 is coupled to pinsetters 116-1 to 116-N and to pinfall sensors 118-1 to 118-N, as well as to display(s) 120, speaker(s) 124, and a printer 126. Lane control system 104 receives video, audio, and/or data signals from a signal source 122 and selectively provides signals from signal source 122 to output devices associated therewith (e.g., displays 120, speakers 124, printer 126, etc.). Bowler consoles 108 also receive signals from signal source 122 and selectively provide the signals from signal source 122 to output devices associated therewith (e.g., displays, speakers, printers, etc.).

Figure 2:
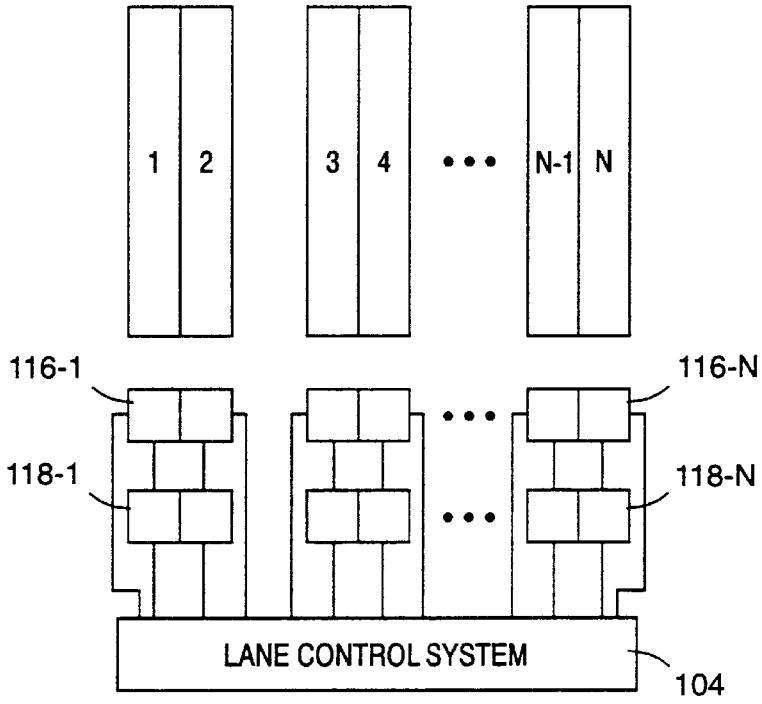
FIG. 2 is a generalized diagram of a bowling center.

As shown in greater detail in FIG. 2, the system includes a plurality of lanes 1, 2, . . . N, wherein the lanes are grouped into lane pairs. Thus, lanes 1 and 2 are a first lane pair; lanes 3 and 4 are a second lane pair; etc. A respective one of pinsetters 116-1 to 116-N and a respective one of pinfall sensors 118-1 to 118-N are associated with each lane and the pinsetters and the pinfall sensors are connected to lane control system 104. Among other things, lane control system 104 controls the operation of the pinsetters and uses pinfall data sensed by the pinfall sensors to provide automatic scoring for bowling games. For league bowling, lane control system 104 may operate the pinsetters so that a cross lane bowling game is played on the two lanes of one or more lane pairs. For open bowling, lane control system 104 may operate the pinsetters so that separate games may be played on each lane. Lane control system 104 is connected to display units 120 for displaying, among other things, scoring information based on the pinfall data and video and/or data signals from signal source 122. Lane control system 104 also supplies the scoring information to an appropriate one or more of bowler consoles 108-1 to 108-N via LAN 102 to provide scoring displays on displays associated with the consoles.

Lane control system 104 is connected via a LAN interface 302 (see FIG. 3) to LAN 102. This connection to LAN 102 permits communication between lane control system 104 and system control computer 106. System control computer 106 controls the overall operation of system 100. System control computer 106 provides accounting control of the bowling lanes and downloads information to lane control system 104. For example, for league bowling, system control computer 106 may download team roster data to the memory 304 of lane control system 104 in accordance with the lane assignments for the teams. The team roster data may include, but is not limited to, the names of team members and handicaps for these team members.

The connection to LAN 102 also permits communication between lane control system 104 and bowler consoles 108-1 to 108-N. As mentioned above, lane control system may, for example, communicate scoring information to a particular one or more of the bowler consoles. Each of the bowler consoles 108-1 to 108-N is associated with a corresponding one of the lanes 1–N. Each bowler console is configured, among other things, to permit bowlers to input data such as bowler identifiers (e.g., names) and lineups for bowling games. The details of bowler consoles 108-1 to 108-N will be described in greater detail below with reference to FIG. 4.

Figure 3:
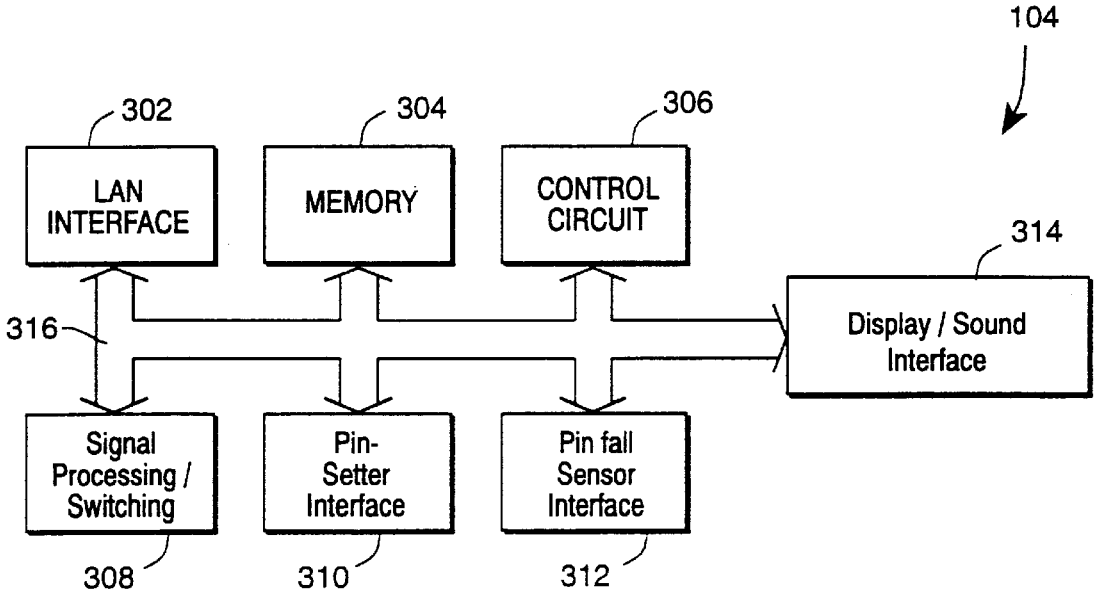
FIG. 3 is a block diagram of a lane control system.

With reference to FIG. 3, lane control system 104 includes a control circuit 306 (such as a microprocessor) that executes various operating instructions stored in memory 304. Memory 304 may be a combination of a read only memory and a read/write memory. Among the operating instructions stored in memory 304 are instructions for automatic scoring based on inputs from pinfall sensors 118-1 to 118-N via pinfall sensor interface 312. Also stored in memory 304 are instructions for controlling pinsetters 116-1 to 116-N via pinsetter interface 310. As mentioned above, the pinsetters may be controlled to permit a game to be played on a single lane or to permit cross-lane bowling on a pair of lanes. The operating instructions stored in memory 304 also include instructions executable by control circuit 306 for implementing the practice bowling features of the present invention. LAN interface 302, memory 304 and control circuit 306 (as well as the other lane control system components to be described below) are connected together via a bus 316.

A signal processing and switching circuit 308 is responsive to instructions from control circuit 306 and/or system control computer 106 for processing and switching video, audio, and/or data signals from signal source 122. In accordance with these instructions, these signals are selectively distributed via display/sound interface 314 to display units 120 and/or speakers 124. Signal source 122 may, for example, be a receiver for receiving over-the-air television signals, a receiver for receiving broadband (e.g., CATV) signals, and/or a receiver for receiving satellite signals. The audio, video, and data signals may include television signals, advertising and promotional information and the like.

It will be appreciated that any number of display units 120 may be associated with each lane (e.g., one or more overhead display units, one or more remote display units positioned at a location at which bowlers wait their turn to bowl, etc.). It will also be appreciated that none, some or all of display units 120 may be provided with speakers 124. Generally speaking, a display unit 120 displays scoring information associated with the lane or lane pair that corresponds thereto. However, in the case of lanes or lane pairs not currently in use, signal processing and switching circuit 308 may (in response to signals from system control computer 106, for example) supply television signals to certain ones of display units 120. Television signals may also be displayed on a particular display unit in response to inputs from bowlers via one of the bowler consoles using a signal processing/switching circuit (not shown).

Figure 4:
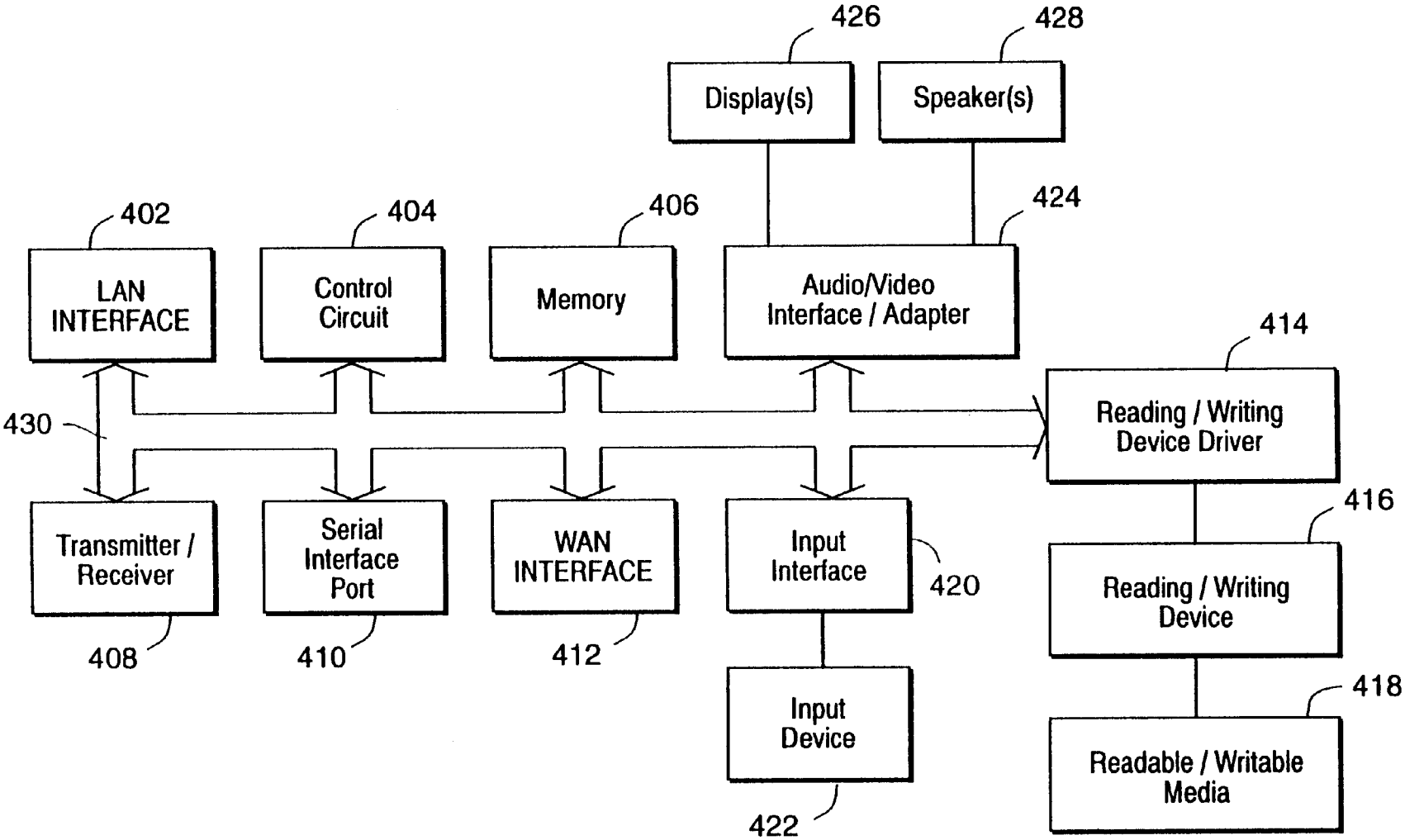
FIG. 4 is detailed block diagram showing a bowler console.

FIG. 4 is detailed block diagram of one of bowler consoles 108-1 to 108-N. The bowler console includes a LAN interface 402 for interfacing the bowler console with LAN 102. A control circuit 404 (such as a microprocessor) controls the console operation. Memory 406 stores data usable by control circuit 404 in the operation of the console. Memory 406 may be a combination of a read-only memory and a read/write memory. LAN interface 402, control circuit 404 and memory 406 (as well as the other bowler console elements to be described below) are connected together by a bus 430.

The bowler console may include one or both of transmitter/receiver 408 (e.g., an infrared transmitter/receiver) and a serial interface port 410. Transmitter/receiver 408 and/or serial interface port 410 permit, for example, communication between the bowler console and various devices including, but not limited to, laptop computer systems, hand-held computer systems, personal digital assistants, interactive wireless communications devices and the like. Of course, other interfaces, such as a parallel port, game port or a universal serial bus (USB) may be provided. In this way, a bowler may conveniently download various data into the bowler console. This downloaded data may include performance data for use by the system during league bowling, open bowling or the practice bowling as described in greater detail below. The data may also include special bowling game programs. It will be apparent that transmitter/receiver 408 and serial interface port 410 (or the other interfaces) also permit data such as performance data to be uploaded from the console to laptop computer systems, hand-held computer systems, personal digital assistants, interactive wireless communications devices and the like.

In addition, the bowler console includes a WAN interface 412 for communication with remotely located servers 110 and personal computers 112 via wide area network 114. This may be accomplished by providing appropriate software (such as an HTML or WAP browser) in memory 406. Using the browser, a bowler may access world wide web (WWW) sites. Additionally or alternatively, communication with remotely located servers 110 and personal computers 112 may be effected from the bowler console via a WAN interface of system control computer 106. Using wide area network 114, bowlers may, for example, access databases on remotely located servers or personal computers to retrieve bowler performance data to be used during league bowling, open bowling or the practice bowling described herein. The bowler performance data may also be uploaded to the remotely located servers or personal computers. Bowlers may also access e-mail and web sites that provide information such as news, sports scores, stock prices, weather reports and the like.

Each bowler console is preferably provided with one or more reading/writing device drivers 414 and reading/writing devices 416 for reading/writing data from/to readable/writable media 418. Examples of readable/writable media 418 include by way of illustration, but not limitation, magnetic storage media such as floppy disks; optical storage media; and semiconductor memory devices such as portable memory cards and smart cards.

Reading/writing device(s) 416 may be configured to read data from credit cards, debit cards, cash cards, check cards and the like. Using data read from these cards, the bowler console communicates via WAN interface 412 and wide area network 114 with financial institution computers. In this way, bowlers can initiate financial transactions such as paying for bowling or making other purchases or payments. This feature is accessible using the user interface described below (e.g., by pressing a predetermined key or button or a predetermined sequence of keys and/or buttons; by making an appropriate selection or selections of options from a menu or menus displayed on the displays; or by pressing a dedicated key provided on the user interface). Of course, credit card data and other purchase data may be input using input device(s) 422.

Reading/writing device(s) 416 may also be configured to read "credit" cards encoded with credits for use at a particular bowling center. For example, a bowling center (or a plurality of bowling centers operated by the same entity) may provide bowlers with cards containing credits for a certain number of games or series of games. The bowler inserts this card into a reading/writing device 416 and the number of credits is decremented in accordance with the number of games bowled by the bowler. Such an arrangement may be advantageously used to encourage bowlers to pre-pay for league bowling. That is, bowlers may purchase cards having credits to enable the bowler to bowl a certain number of league games. The bowling center may provide an incentive for pre-payment by providing a discount on the price of pre-paid games.

The bowler console also includes input device(s) 422 connected to bus 430 via an input device interface 420. Input device(s) that may be utilized include, but are not limited to, a keyboard, a pointing device, a microphone, a joystick, and a game controller. Display(s) 426 and speaker(s) 428 provide audio and visual outputs to bowlers using the console. Display(s) 426 and speaker(s) 428 are connected to bus 430 via an audio/video interface (sound card)/adapter 424. Display(s) 426 may be, for example, liquid crystal displays or CRTs. Display(s) 426 may also be implemented as touch-sensitive screens.

Figure 5:
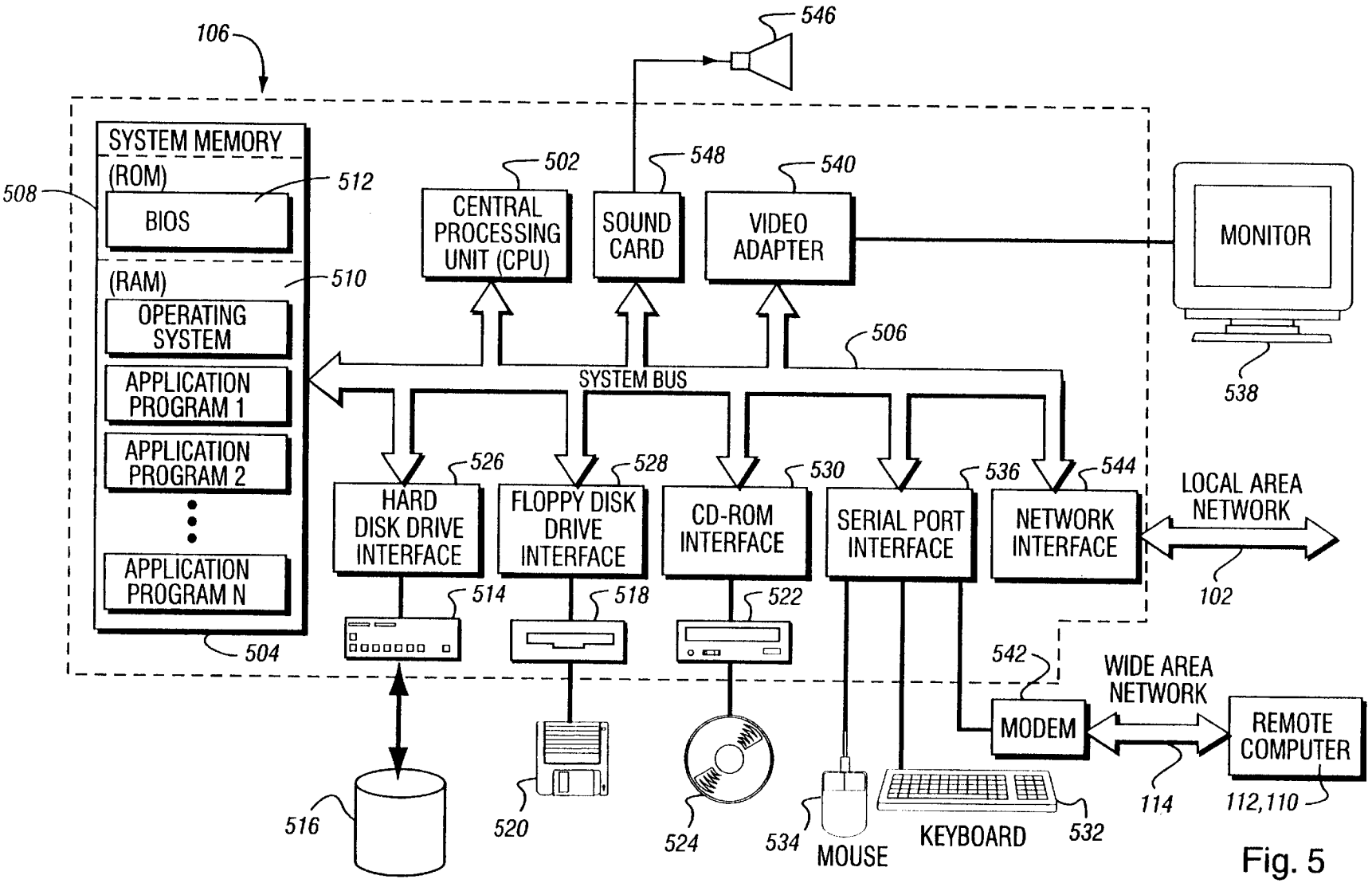
FIG. 5 illustrates a personal computer suitable for use as the system control computer.

FIG. 5 illustrates a personal computer suitable for use as the system control computer 106. System control computer 106 includes a processing unit 502 and a system memory 504. A system bus 506 couples various system components including system memory 504 to processing unit 502. System bus 506 may be any of several types of bus structures including a memory bus or memory controller, a peripheral bus, and a local bus using any of a variety of bus architectures. System memory 504 includes read only memory (ROM) 508 and random access memory (RAM) 510. A basic input/output system (BIOS) 512, containing the basic routines that help to transfer information between elements within system control computer 106, such as during start-up, is stored in the ROM 508. System control computer 106 further includes various drives and associated computer-readable media. A hard disk drive 514 reads from and writes to a (typically fixed) magnetic hard disk 516; a magnetic disk drive 518 reads from and writes to a removable "floppy" or other magnetic disk 520; and an optical disk drive 522 reads from and, in some configurations, writes to a removable optical disk 524 such as a CD ROM or other optical media. Hard disk drive 514, magnetic disk drive 518, and optical disk drive 522 are connected to system bus 506 by a hard disk drive interface 526, a magnetic disk drive interface 528, and an optical drive interface 530, respectively. The drives and their associated computer-readable media provide nonvolatile storage of computer-readable instructions, data structures, program modules, bowling game programs, bowler data and other data for system control computer 106.

A number of program modules may be stored on hard disk 516, removable magnetic disk 520, optical disk 524 and/or ROM 508 and/or RAM 510 of system memory 504. Such program modules may include an operating system providing graphics and sound APIs, one or more application programs, other program modules, program data and bowling game data. A user may enter commands and information into system control computer 106 through input devices such as a keyboard 532 and a pointing device 534. Other input devices may include a microphone, joystick, game controller, satellite dish, scanner, or the like. These and other input devices are often connected to processing unit 502 through a serial port interface 536 that is coupled to system bus 506, but may be connected by other interfaces, such as a parallel port, game port or a universal serial bus (USB). A monitor 538 or other type of display device is also connected to system bus 506 via an interface, such as a video adapter 540. A speaker 546 is connected to system bus 506 via a sound card 548.

System control computer 106 includes a WAN interface 542 (such as a modem or other means) for establishing communications over wide area network 114, such as the Internet. If the WAN interface is a modem (internal or external), it may be connected to system bus 506 via serial port interface 536. A LAN interface 544 is provided for allowing system control computer 106 to communicate with lane control system 104 and the bowler consoles via local area network 102. System control computer 106 will typically include other peripheral output devices, such as printers and other standard peripheral devices.

Figure 6:
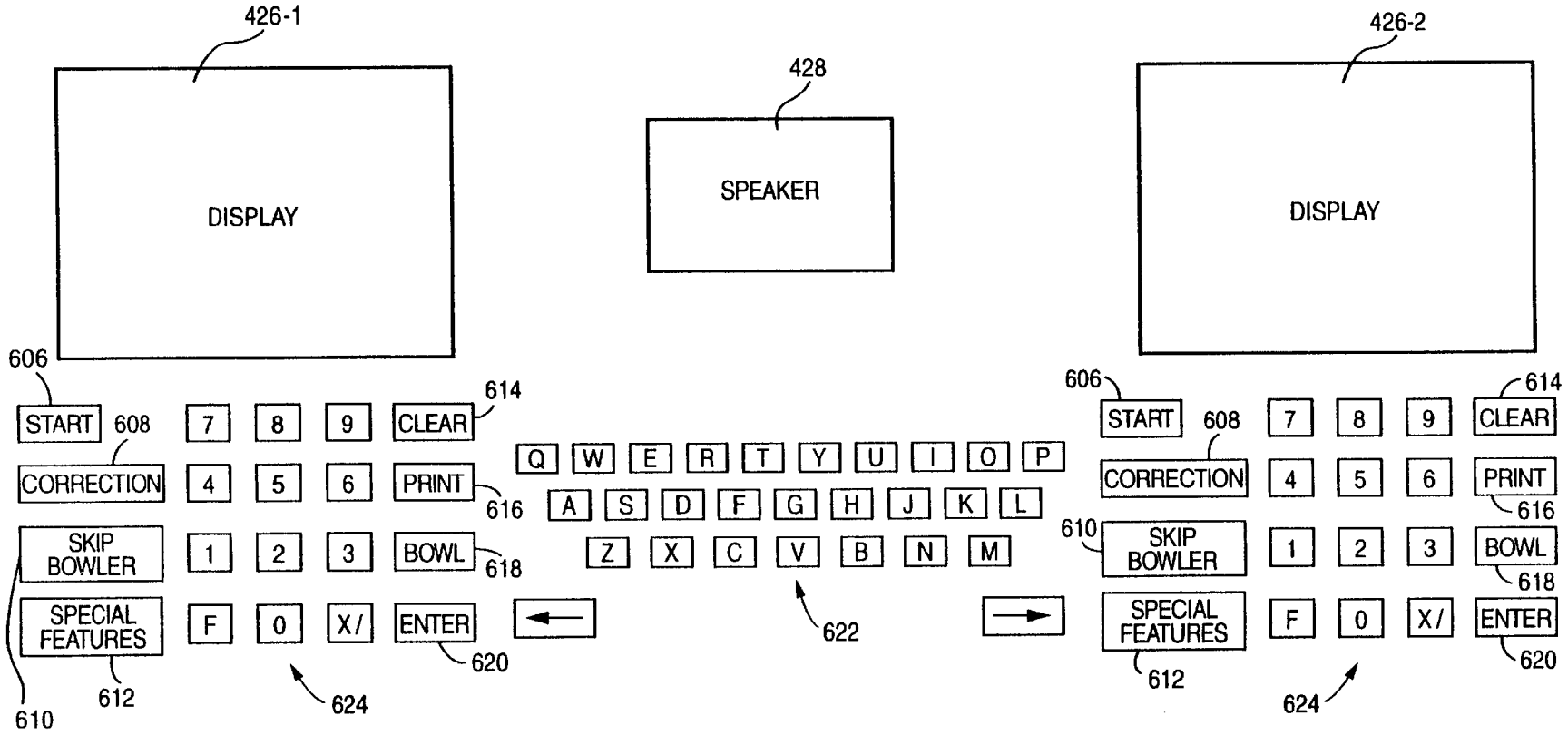
FIG. 6 shows an illustrative, but non-limiting, example of a user interface for the bowler console.

FIG. 6 shows an illustrative, but non-limiting, example of a user interface for the bowler consoles 108-1 to 108-N of the bowling center system shown in FIG. 1. This user interface includes first and second displays 426-1 and 426-2 that are used to display bowler line-up and scoring data as well to display prompts, instructions and/or menus usable by bowlers to set up and access particular system features. Displays 426-1 and 426-2 may be liquid crystal displays or CRTs, for example. A numeric keypad (0–9) 624 and various buttons are associated with each of the first and second displays to input numeric data and to access various features of the system. Start button 606 is used to begin operations. Correction button 608 is pressed to correct errors in scoring data (e.g., when the pinfall sensor incorrectly senses the number of pins knocked down). Skip bowler button 610 is pressed to skip over the bowler currently due to bowl on the corresponding lane. Special features button 612 allows bowlers to access certain special features of the system such as, for example, the practice bowling feature of the present invention. Clear button 614 is used to clear the scores shown on the corresponding one of displays 426-1 and 426-2, especially after the completion of a game. Print button 616 is pressed to cause a print out of the scoring data to be printed using a printer (not shown). Bowl button 618 is pressed when all the appropriate bowler data and/or lane configuration data has been entered and/or set in order to begin bowling. Enter button 620 is pressed, for example, to select menu options or when all the letters of a particular bowler's name have been entered using the alphanumeric keypad 622.

Of course, the interface may be arranged in other manners and the present invention is not limited in this respect. For example, displays 426-1 and 426-2 may comprise touch-sensitive screens and some or all of the above-described buttons and keys may be displayed on the touch sensitive screen. In addition, it will be appreciated that the details of lane control system 104, system control computer 106, bowler consoles 108-1 to 108-N are provided by way of illustration, not limitation. The features described in this patent application may be implemented in bowling centers having various arrangements as will be readily apparent to those in the art.

The bowling center is preferably configured to store bowler data. This bowler data includes, but is not limited to, some or all of the following: bowler identifying data for identifying bowlers (e.g., names and/or identifiers such as identification numbers); bowler handicap data for each bowler; game time and date information; lane identification information for identifying the lanes on which games were bowled; and scoring information (e.g., for each ball rolled by the bowlers during games, which pins were knocked down; the bowler's score; etc.).

The control of the pinsetter(s) during practice bowling may be based on some of this bowler data and, in particular, may be based on what may be viewed as "performance data." In the simplest case, the pinsetter control is based on the bowler's handicap. Alternatively or in addition, the pinsetter control may be based on data indicative of the bowler's success during previous practice games, during the present practice game and/or during previous non-practice games (e.g., during league bowling) at knocking down particular pin configurations. For example, unless a bowler bowls a perfect "300" game (i.e., all strikes), a bowler has one or more opportunities to make a spare during each game. The bowler data may include data indicative of the pin configurations for these spare opportunities and data indicative of whether the bowler was successful/unsuccessful at making the spare. Thus, as a bowler bowls, lane control system 104 tracks the pin configurations that remain after a bowler rolls the first ball of a frame and whether or not the bowler is able to successfully knock down these remaining pins with the second ball of the frame.

The pin configurations that remain after the bowler rolls the first ball of a frame may be designated in any convenient manner and the present invention is not limited in this respect. For example, each of the 10 pins may be designated by a bit and the status of each bit indicates whether the corresponding pin was knocked down (bit status="1") or remained standing (bit status="0") after the first roll. Another bit may be utilized to indicate whether the bowler successfully knocks down the remaining pins with the second ball of the frame (e.g., "1"=successfully knocked down remaining pins; "0"=unsuccessful). In another example, identifiers (such as alphanumeric characters) may be used to designate pin configurations. In this case, using data from the pinfall sensors, lane control system 104 determines the configuration of the pins that remain standing after the bowler rolls the first ball of a frame and then accesses a table stored in memory 304 to determine the identifier corresponding to that particular pin configuration. This identifier is then stored, along with data (such as the "1" and "0" bits described above) indicative of whether or not the bowler successfully "picked up" or "made" (i.e., knocked down all the remaining pins) the spare with the second ball.

If desired, the system may track the pin configurations of any pins that remain standing after an unsuccessful second ball. This data may be used to provide additional information to be utilized by the system when controlling a practice session for a bowler. For example, the pins remaining after an unsuccessful second ball may indicate, for example, a tendency by a bowler to "chop" a pin from a configuration of two or more adjacent pins.

The bowler's success at knocking down particular pin configurations may be maintained in terms of the number of successes for each particular pin configuration and the number of times the bowler has attempted to knock down the pins arranged in that particular pin configuration. The bowler's success for a particular pin configuration may be determined relative to the success of other bowlers at knocking down the pins of the same configuration. This success may be determined relative to all bowlers or relative to some particular group of bowlers (e.g., bowlers having similar scoring averages, bowlers in the same league, bowlers bowling in the same "house", or bowlers of some other predetermined group). The success may also be determined relative to a time window such as a particular date (e.g., in the last three months). In this case, the performance data may include time and date data that is associated with the pin configuration data and the success data. In addition, the success may also be determined relative to a recent number of attempts (e.g., the last 10 attempts). In this case, the bowler data may include sequence data that is associated with the pin configuration data and the success data.

The performance data may additionally or alternatively be derived based on an ability test provided by the system. The ability test may, for example, comprise a sequence of pin configurations that the bowler attempts to knock down. The bowler's success at knocking down the pin configurations in the pin configuration sequence may be used as a measure of the bowler's ability. This ability data may be used by itself or in combination with other performance data such as handicap and prior game performances. The ability test may be useful, for example, when a bowler does not have past individual past performance data or when the amount of data (e.g., with respect to certain pin configurations) is minimal. In the case where the amount of data is minimal with respect to certain pin configurations, the ability test, if desired, may be limited to those certain pin configurations.

The bowler performance data is stored in memory. The particular memory in which the performance data is stored is not critical, provided the data is accessible for implementing the practice bowling feature. For example, the bowler performance data may be stored in memory 406 of the bowler console; in memory 304 associated with lane control system 104; or in a memory associated with system control computer 106. The performance data may also be stored on a portable read/write memory module (e.g., magnetic floppy disk, optical disk, smart card, etc.) using reading/writing device 416 associated with the bowler consoles or using a read/write device associated with system control computer 106. In addition, the performance data may also be communicated via WAN 114 to a remotely located computer for storage. It will be apparent that storing the data in an Internet-accessible database is advantageous because such a database may be accessed using any Internet-capable bowler console. Thus, access to a bowler's performance data is not limited to a particular house and a bowler may access and update the Internet-accessible database from any suitably equipped house in the world. To some extent, the ability to access data from any suitably equipped house may be accomplished using portable memory media. That is, a bowler may bring the portable memory media to any suitably equipped house and access the performance data on the portable memory media. Obviously, however, this requires that the bowler have the portable memory media in his/her possession when the bowler bowls. This can be inconvenient and is subject to forgetfulness on the part of the bowler.

If desired, system control computer 106 can be configured to provide an Internet-accessible database that stores, among other things, performance data for one or more bowlers who regularly bowl at that house. When one of these regular bowlers bowls at another different house, he/she can enter an appropriate uniform resources locator (URL) via a suitable configured bowler console to access the data stored by system control computer 106 at the bowler's usual house. The remote access may be a fee-based access. This fee may be a flat fee paid periodically (e.g., monthly, quarterly, semi-annually, annually, etc.) or a per-access fee charged to a credit card, to a debit card, to a check card, to a charge card, or to an account maintained by the bowler. In some cases, the fee may be an optional add-on to league fees paid by league bowlers. Of course, other fee arrangements may be utilized and the present invention is not limited in this respect.

In an alternative arrangement, an Internet-accessible database may be provided that contains data for the bowlers of more than one house. For instance, a database may be provided for those bowlers that bowl at any house of a particular franchise. This database may be maintained on the system control computer of one house of that franchise or may be separately maintained on some other computer. This other computer may be located at one of the houses of the particular franchise or may be at some other location. While it is likely that such a database would be maintained and operated by the franchiser or one of the franchisees, this is not a requirement and these entities may make arrangements with some other entity to provide the database as a service to its customers. Fee-based access for this service may be provided along the lines described above.

It is also possible that such a database may be provided for bowlers that bowl at any house of any franchise. This database may be operated and maintained, for example, by an entity that is independent of any particular franchise. The independent entity may offer the operation and maintenance of such a database as a service that any house equipped for Internet-access may make available to its bowlers. It will be apparent that the service may be offered to bowlers by either the house or the independent entity and that various arrangements (including those mentioned above) may be made in terms of fees.

In accordance with one aspect of the present invention, lane control system 104 controls one or more of the pinsetters to permit practice bowling. In one embodiment, the practice bowling is implemented as a modification of a normal bowling game. In another embodiment, practice bowling is implemented by providing a practice session in which the pinsetter(s) is/are controlled to set particular pin configurations.

The practice bowling feature may be accessed via the interface shown in FIG. 6 (e.g., by pressing a predetermined key or button or a predetermined sequence of keys and/or buttons; by making an appropriate selection or selections of options from a menu or menus displayed on displays 426-1/426-2; or by pressing a dedicated key (not shown)). In certain instances, the system is configured to then prompt the bowler to enter a bowler identifier. This identifier may be a bowler identifier number, the bowler's name, etc. The identifier may be entered directly using the numeric keypad 624 and/or alphanumeric keypad 622, or may be selected from a menu. The user interface is configured to provide various options for the bowler to appropriately access stored bowler performance data. As described above, bowler performance data may be stored, for example, in the memory of system control computer 106, on a portable memory module, or in a remote storage system. In the case of remotely stored data, the interface may provide a listing of remote facilities (e.g., other bowling centers) or web sites to which the system has access. The performance data is used during the practice session as will be described in greater detail below. In other instances (e.g., the system is not configured to access stored performance data or a particular bowler does not have stored performance data), the system prompts the bowler to enter certain performance data such as handicap and this entered data is used during the practice session.

Figure 7:
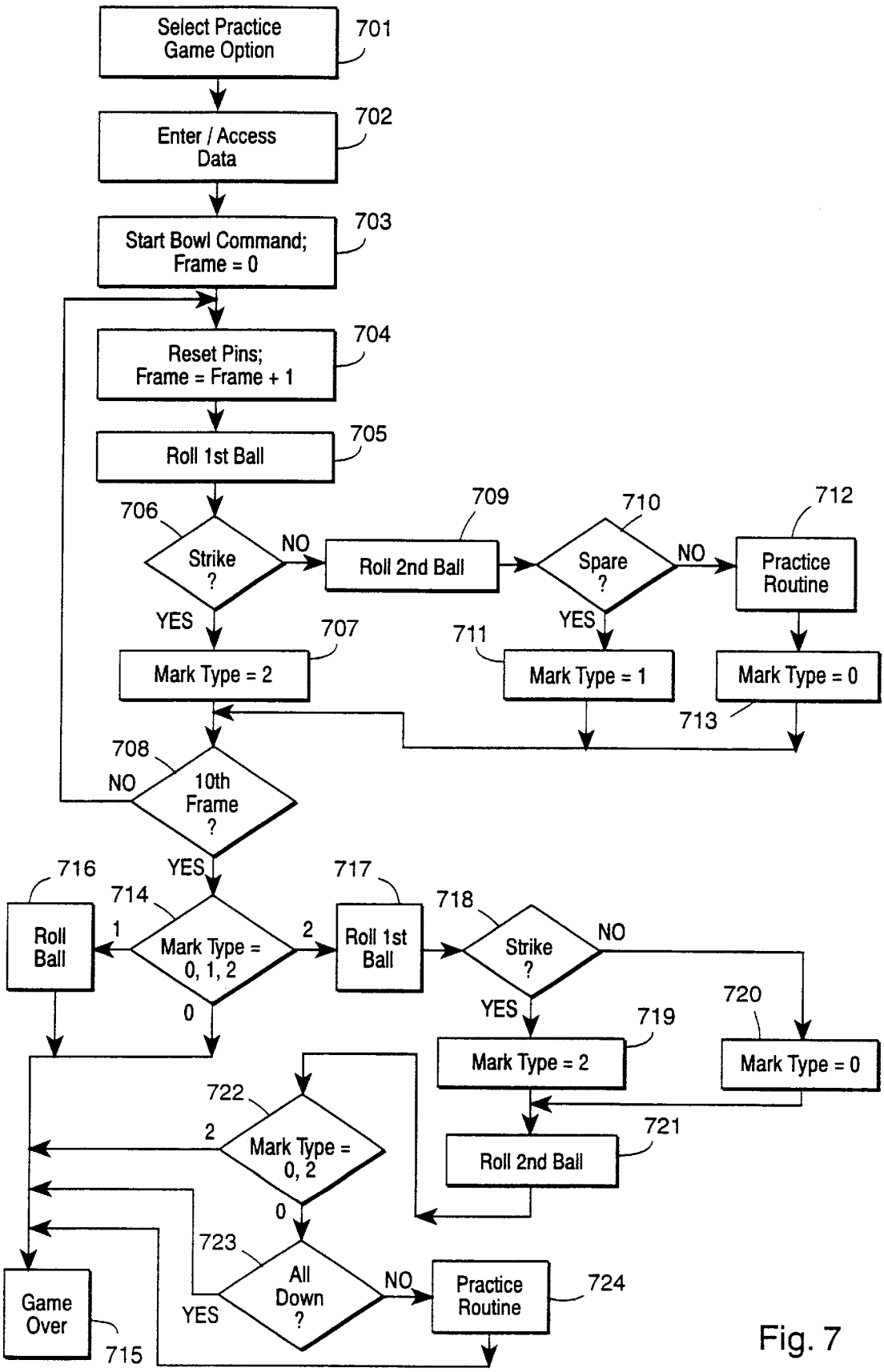
FIG. 7 is a flow chart showing an illustrative, but non-limiting, implementation of a practice game in accordance with an embodiment of the present invention.

FIG. 7 is a flow chart showing an illustrative, but non-limiting, implementation for a bowler bowling a practice game in accordance with the present invention. The bowler begins by selecting a practice game option using the user interface of the bowling system (block 701). For example, the user interface may provide a menu choice on display 426-1/426-2 that is selectable by the bowler to input the practice game selection. Alternatively, the user interface may be provided with a special key for selecting a practice game or the system may be responsive to the actuation of a particular sequence or combination of keys and/or buttons for selecting a practice game. Of course, the present invention is not limited to any particular method for selecting a practice game and the above examples are provided merely by way of illustration.

Data to be used by the system during the practice game is then entered and/or accessed (block 702). The interface is configured to request that the bowler enter an identifier such as a name or an identification number. The entered identifier is usable to access performance data stored in the various manners mentioned above. The user interface may also be configured so that the bowler can specify that performance data is stored on a portable memory module received by reading/writing device 416 of the bowler console or received by a reading/writing device of system control computer 106 (e.g., a magnetic disk 520 or an optical disk 524). The user interface may also be configured so that the bowler can specify that the system should use data from a remotely located, offsite database such as the system control computer of another bowling center, a web site, or the bowler's home computer. The user interface may be configured to permit a bowler to make such specifications by providing appropriate menu choices and/or prompts for appropriate inputs such as URLs and the like.

Finally, because not all bowlers will have accessible stored performance data, the user interface may be configured to prompt the bowler to enter his/her average via numeric keypad 624, along with any other data that the system uses to select one of a plurality of predetermined settings for the practice game.

The bowler inputs a command to begin bowling and the frame count is set equal to 0 (block 703). At block 704, the pins are reset (if necessary) and the frame count is incremented by 1. The bowler then rolls the first ball of the frame (block 705). Using the data provided by the pinfall sensor, a determination is made (block 706) as to whether all of the pins were knocked down with the first ball of the frame (i.e., whether the bowler rolled a strike). If so, the mark type indicator is set equal to 2 (block 707) and control passes to block 708. If it is determined at block 706 that not all the pins were knocked down with the first ball of the frame (i.e., one or more pins remains standing), the configuration of the remaining pins is determined and the bowler rolls a second ball (block 709) and attempts to knock down these remaining pins. Using the data provided by the pinfall sensor, a determination is made (block 710) as to whether all of the pins were knocked down with the second ball of the frame (i.e., whether the bowler made a spare). If so, the mark type indicator is set equal to 1 (block 711) and control passes to block 708. If it is determined at block 710 that not all the pins were knocked down with the second ball, a practice routine is performed (block 712). The practice routine will be described in greater detail below with reference to FIG. 8. After the practice routine is performed, the mark type indicator is set equal to 0 (block 713) and control passes to block 708.

At block 708, a determination is made as to whether the frame is the tenth frame. If not, control returns to block 704 and the pins are reset and the frame number is incremented by 1. If at block 708, the frame is determined to be the tenth frame, the mark type indicator is examined (block 714). If the mark type indicator is equal to 0, the game is over (block 715). If the mark type indicator is equal to 1 (indicating that the bowler obtained a spare in the tenth frame), the bowler rolls a single ball (block 716). After rolling this ball, the game is over (block 715).

If the mark type indicator is determined to be equal to 2 at block 714, the bowler rolls a first extra ball (block 717). Using the data provided from the pinfall sensor, a determination is made (block 718) as to whether all the pins were knocked down (i.e., whether the bowler rolled a strike). If so, the mark type indicator is set equal to 2 at block 719; if not the configuration of the remaining pins is determined and the mark type indicator is set equal to 0 at block 720. The bowler then rolls a second ball (block 721) and then a determination is made (block 722) as to whether the mark type indicator is equal to 0 or 2. If the mark type indicator is equal to 2, the game ends (block 715). If the mark type indicator is equal to 0, then a determination is made as to whether all the pins were knocked down with the second ball (block 723). If so, the game ends (block 715). If not, the practice routine is executed (block 724). After the practice routine is executed, the game ends (block 715).

Figure 8:
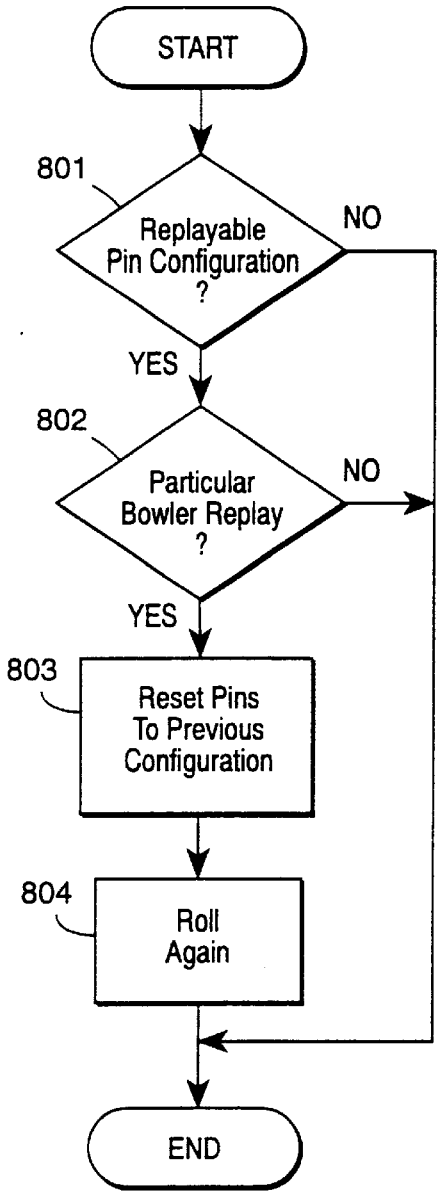
FIG. 8 is a flow chart illustrating the practice routine of FIG. 7.

The practice routine is illustrated in FIG. 8. With reference to the routine shown in FIG. 7, entry into the bowler practice routine illustrated in FIG. 7 is at blocks 712 and 724. Initially, a determination is made as to whether the configuration of remaining pins constituted a replayable pin configuration (block 801). In general, the system may be configured to designate certain pin configurations as "non-replayable" configurations. These non-replayable configurations are configurations that are relatively unlikely to occur during bowling or those for which the system operator does not wish to permit a replay. For example, if the first ball rolled by the bowler knocks down only a single pin (e.g., the 7 or 10 pin), the system operator may not wish to permit the bowler to replay (or practice) the second ball if the bowler fails to knock down all the pins. Similarly, if the bowler rolls the first ball into the gutter (or channel), the system operator may not wish to permit a replay of the second ball if the bowler fails to knock down all the pins with the second roll. Of course, block 801 may be omitted, if desired, in which case all pin configurations will constitute "replayable" pin configurations.

If it is determined that the pin configuration is a replayable configuration, one or more criteria are applied to determine whether the particular bowler will replay the second ball (block 802). An example of such a criterion is the particular bowler's success rate at knocking down all the pins of the particular pin configuration. The particular bowler's success rate may be compared to the overall success rate of some group of bowlers at knocking down all the pins of that particular configuration to thereby make the spare. If the particular bowler's success rate is less than the overall success rate (e.g., by some predetermined amount), the pinsetter resets the pins in the same configuration as they were in after the first ball (block 803). The bowler then rolls again to attempt to knock down all the pins of the configuration, thereby allowing the bowler to practice making the spare (block 804). If the particular bowler's success rate is greater than the overall success rate (e.g., by some predetermined amount), then control passes back to the main routine.

In addition, the practice routine may optionally be configured to give a bowler more than one opportunity to make a spare. For example, if a bowler is having problems with a particular configuration (e.g., his/her success rate with the configuration is significantly less than other bowlers either generally or at the particular average), the system may reset the pins in the configuration more than once, even if the bowler is successful with one or more previous practice balls at knocking down the pins. The system may also be configured to provide practice balls until the bowler knocks down all the pins a certain number of times. Again, the number of times the bowler is required to knock down all the pins may be dependent on the particular bowler's success rate relative to the success rate of other bowlers or on the bowler's average.

The above-mentioned "success rates" for a bowler may be viewed in several different ways. For example, the success rates may be provided in terms of bowlers of all abilities. The success rates may also be provided in terms of bowlers of particular abilities. For example, the success rates may be provided for bowlers having averages less than 150 pins, bowlers having averages between 150 and 185 pins and bowlers having averages higher than 185 pins. In this way, it is possible for the system to provide a practice session tailored for the particular ability level of a bowler by comparing the performance of a particular bowler with other bowlers in the same ability range. Thus, a bowler having an average less than 150 pins will generally not be expected to achieve the same success rate at knocking down all the pins of various pin configurations as bowlers having an average greater than 185 pins.

In some instances, the system may be configured to reset the pins even if the particular bowler's overall success rate is greater than the overall success rate. For example, if the bowler misses the same spare twice in the same practice game (or series of practice games), the system may reset the pins for the bowler to practice that spare after the second miss.

Other criteria may also be used at block 802 to determine whether a bowler rolls again at a particular configuration.

For example, if the bowler missed the same particular pin configuration in a recent previous game, the bowler may be prompted to roll again. The criteria may also include the particular bowler's average. The above criteria may be applied individually or in combination.

Of course, the above description is merely provided by way of illustration, not by way of limitation. Thus, the above routine may be easily modified to provide, for example, for multi-player practice games. In addition, the routine may be modified to include the generation and storage of performance data to be used for future practice bowling. In this case, if the bowler fails to knock down all of the pins with the first ball of a given frame, data from the pinfall sensor is used to identify which pins remain standing. Data regarding the configuration of the remaining pins is stored, along with data regarding whether the bowler knocked down all of these remaining pins with the second ball of the frame.

The system and the user interface thereof may be configured to permit the user to skip replaying a particular pin configuration if desired.

Figure 9:
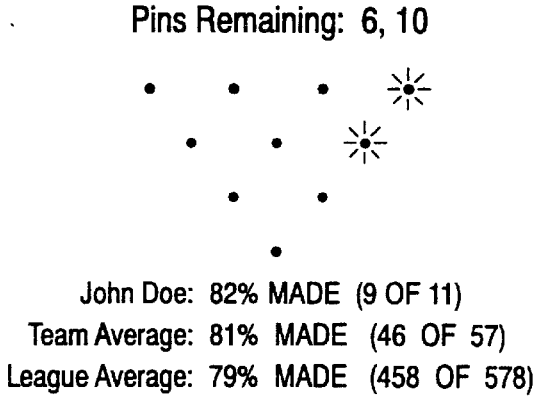
FIG. 9 shows an exemplary display.

During practice bowling, one or more of the displays 120 and displays 426-1 and 426-2 may be used to display graphical and statistical information associated with various pin configurations. The statistical information may include, but is not limited to, the particular bowler's success rate at knocking down all the pins of the particular configuration, other bowlers' success rates at knocking down all the pins of the same particular configuration, the actual numbers of attempts and successes by the particular bowler and the other bowlers, the success rates for bowler's of various averages and the like. The statistical information for a particular bowler may be provided in terms of the overall success of the bowler at knocking down particular pin configurations, as well as in terms of "trends" (e.g., the bowler's success the last ten times for the particular pin configuration, the bowler's success over the last n games for the particular configuration, the bowler's success over some predetermined period of time such as n weeks or months). It will be appreciated that these trends may be based on values set by the system operator or by the bowler. The statistics may be expressed in terms of percentages, in terms of the number of success/failures and the number of attempts, or both. FIG. 9 shows an example of one display that may be utilized. It will be appreciated that this display is for purposes of illustration only and other displays of the same or similar information are contemplated.

One or more of displays 120 and displays 426-1 and 426-2 may also be controlled to display data indicative of the pin configurations that remain after first balls that fail to knock down all the pins. This display may be a textual display that simply identifies by position number the pins in the configuration (e.g., 2, 5). Alternatively, the pins configuration may be displayed using a combination of text and graphics as is the case in FIG. 9.

The system preferably provides feedback to the bowler during practice games. For example, in those situations in which the system resets the pin configuration of a missed spare, the system may provide a visual and/or aural communication to the bowler to that effect. In addition, if the system does not reset a particular pin configuration after a missed spare because, for example, the bowler's success rate at making that spare exceeds the replay criterion, the system may provide a visual and/or aural communication to the bowler to that effect.

The system may be configured to generate a print-out via printer 126 showing the statistics of the practice session including, but not limited to, the pin configurations that were set and the success/failure of the bowler at knocking down the pins of these configurations.

In a second embodiment, the system provides a practice session in which a bowler bowls at a sequence of pin configurations. The system sets the pin configurations based on the performance data of the bowler. For example, the pinsetter may be controlled to set pin arrangements that were missed by the bowler during recent games. The pinsetter may also be controlled to set particular types of pin configurations for the bowler's practice. For example, the bowling data may indicate that a particular bowler has a propensity to miss one pin spares. Accordingly, the pinsetter may set a series of one-pin configurations for the bowler to practice. During the practice session, the system may continue to set a particular pin configuration until the bowler makes it a predetermined number of times in a practice session. This may be a number of times in succession or the system may be configured to set the pin configurations at random or at set intervals throughout the practice session.

Figure 10:
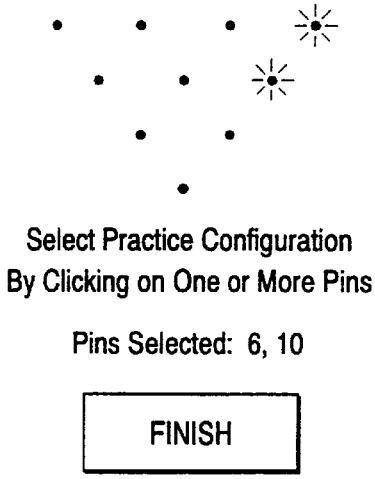
FIG. 10 is an on-screen display for software usable to develop a personalized practice session.

In still another embodiment, a bowler may be provided with software that allows a bowler to develop a personalized practice session. This software may be loaded onto the bowler's personal computer. The bowler's personal computer may be similar to the personal computer described above with reference to FIG. 5. The software allows the bowler to designate certain pin configurations for practice. This designation may be made, for example, using an on-screen display of the ten pins typically arranged on the pin deck of a lane as shown in FIG. 10. The bowler may select one or more of these pins (e.g., via a keypad or a pointing device such as a mouse) to designate a practice pin configuration and then pressing FINISH button 1001 to add that configuration to the practice session. The pins selected for the practice pin configuration may, for example, be identified by an on-screen color that is different from the on-screen color of the nonselected pins, an on-screen brightness that is different from the on-screen brightness of the non-selected pins, etc. A textual identification of the selected pins may also be provided as shown in FIG. 10. The software may also allow the bowler to identify areas in which the bowler has been having problems. For example, the bowler may indicate he/she has been having problems with single pin spares, with "chopping" pins from pin configurations of adjacent pins, or with "double wood" configurations. In one implementation, this practice session information is stored on a portable memory module such as a magnetic disk, a flash memory card, or a so-called "smart card." The bowler brings this portable memory module to the bowling center and places the module in an appropriate read/write device. In another implementation, the personalized practice session data may be provided from a laptop or hand-held computing device to the bowler consoles via the serial interface port and/or transmitter/receiver thereof. In still another implementation, the practice session data entered by the bowler is stored in an Internet-accessible memory. The bowling center accesses the data stored in this memory and uses the accessed data to control the practice session.

The bowling center system may also be configured to keep a bowler's actual score and the bowler's score with respect to those spares that the bowler "should have made" as determined with respect to statistics of other bowlers or with respect to those spares that the bowler made with first practice balls. In this way, the bowler can be provided with an indication of how making the spares that the bowler "should have made" would have impacted on the bowler's score.

Because practice games will generally take longer than regular games, the bowling center may ascribe a cost to practice bowling games that is different (and generally higher) than the cost of regular bowling games.

The concept of providing an additional attempt to make a spare can provide the basis for additional types of bowling games. For example, a bowler may be given an opportunity to count one or more practice balls during a game and have a "secondary" score determined on the basis of the results obtained using the practice balls. The bowler might, for example, be limited to counting the practice balls for knocking all the pins of pin configurations which are "difficult", e.g., those spares that the particular bowler, some group of bowlers or all bowlers fail to make some predetermined percentage of the time.

The system is not limited to controlling the practice bowling based on the specific performance data associated with a particular bowler. Thus, using information such as handicap, average, average number of games bowled per month and the like, the system can control the pinsetter in accordance with one of a plurality of predetermined programs that is determined to be best suited for bowlers having the entered profile information.

Figure 11:
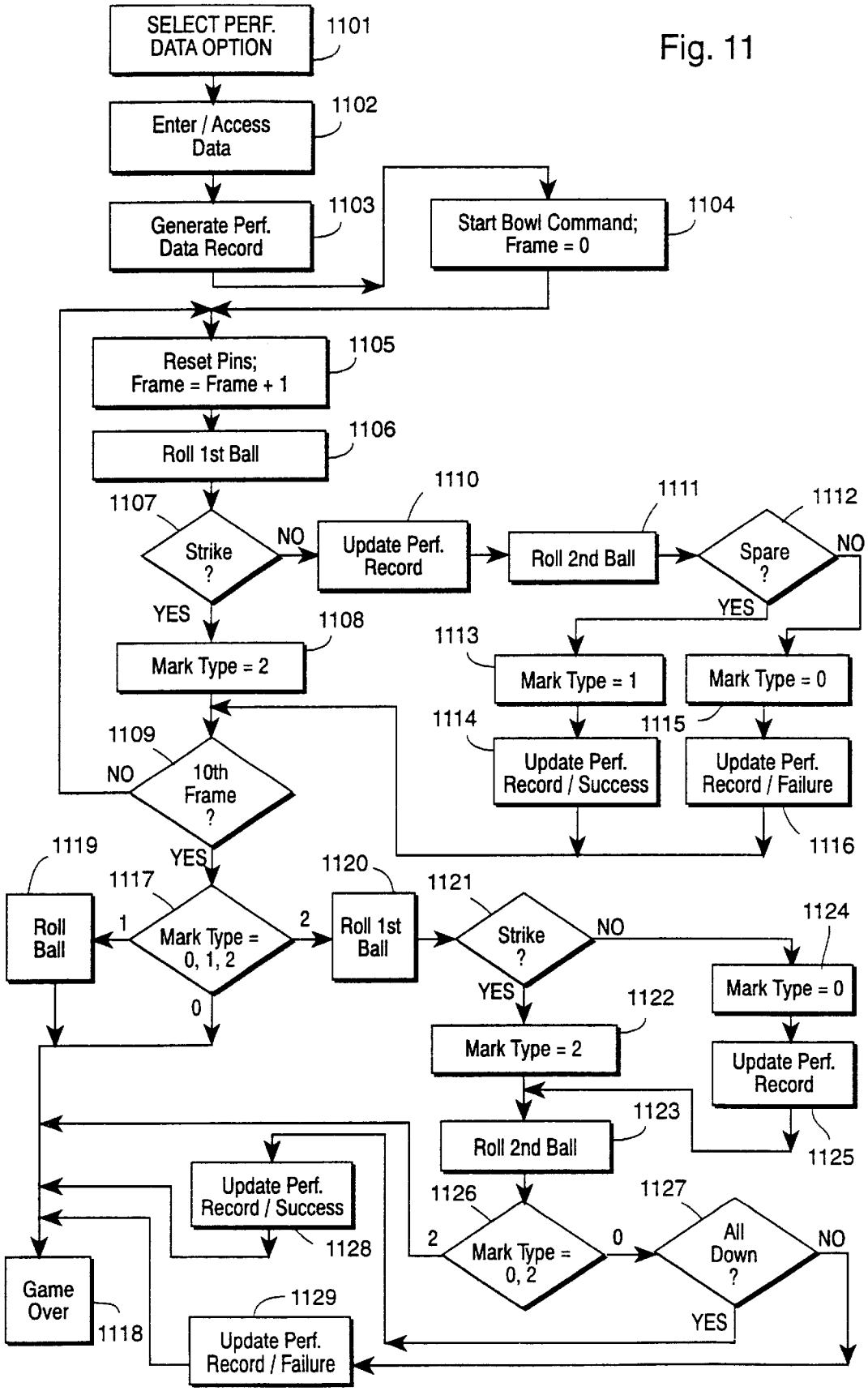
FIG. 11 is a flow chart showing an illustrative, but non-limiting, implementation for generating bowler performance data during regular bowling games for use in the bowling practice feature of the present invention.

FIG. 11 is a flow chart showing an illustrative, but non-limiting, implementation for generating bowler performance data during regular bowling games for use in the bowling practice feature of the present invention. The bowler begins by selecting a regular game/performance data option using the user interface of the bowling system (block 1101). For example, the user interface may provide a menu choice on display 426-1/426-2 that is selectable by the bowler to input the game selection. Alternatively, the keypad of the user interface may be provided with a special key for selecting a regular game/performance data or the system may be responsive to the actuation of a particular sequence or combination of keys and/or buttons for selecting a regular game/performance. Of course, the present invention is not limited to any particular method for selecting a practice game and the above examples are provided merely by way of illustration.

Data to be used by the system during the game is then entered and/or accessed (block 1102). The interface is configured to request that the bowler enter an identifier such as a name or an identification number. The entered identifier is usable to access, for example, handicap data. Because not all bowlers will have accessible stored data, the user interface may be configured to prompt the bowler to enter his/her average via the keypad.

A performance data record is generated at block 1103. This record includes bowler identifier data (e.g., identifier number or name) for identifying the bowler, time and date information indicative of the time and date of the game, the house, and the lane number(s) on which the game is being bowled. This record is updated during the game as will be explained below.

The bowler inputs a command to begin bowling and the frame count is set equal to 0 (block 1104). At block 1105, the pins are reset (if necessary) and the frame count is incremented by 1. The bowler then rolls the first ball of the frame (block 1106). Using the data provided by the pinfall sensor, a determination is made (block 1107) as to whether all of the pins were knocked down with the first ball of the frame (i.e., whether the bowler rolled a strike). If so, the mark type indicator is set equal to 2 (block 1108) and control passes to block 1109. If it is determined at block 1107 that not all the pins were knocked down with the first ball of the frame (i.e., one or more pins remains standing), the performance record is updated with data indicative of the configuration of the remaining pins (block 1110). The bowler rolls a second ball (block 1111) and attempts to knock down these remaining pins. Using the data provided by the pinfall sensor, a determination is made (block 1112) as to whether all of the pins were knocked down with the second ball of the frame (i.e., whether the bowler made a spare). If so, the mark type indicator is set equal to 1 (block 1113), the performance record is updated at block 1114 to reflect the bowler's success at making the spare, and control passes to block 1109. If not, mark type indicator is set equal to 0 (block 1115), the performance record is updated at block 1116 to reflect the bowler's failure at making the spare, and control passes to block 1109.

At block 1109, a determination is made as to whether the frame is the tenth frame. If not, control returns to block 1105 and the pins are reset and the frame number is incremented by 1. If at block 1109, the frame is determined to be the tenth frame, the mark type indicator is examined (block 1117). If the mark type indicator is equal to 0, the game is over (block 1118). If the mark type indicator is equal to 1 (indicating that the bowler obtained a spare in the tenth frame), the bowler rolls a ball (block 1119). After rolling this ball, the game is over (block 1118). If the mark type indicator is determined to be equal to 2 at block 1117, the bowler rolls a first ball (block 1120). Using the data provided from the pinfall sensor, a determination is made (block 1121) as to whether all the pins were knocked down (i.e., whether the bowler rolled a strike). If so, the mark type indicator is set equal to 2 (block 1122) and the bowler rolls a second ball at 1123. If not, the mark type indicator is set equal to 0 (block 1124) and the performance record is updated with data indicative of the configuration of the remaining pins (block 1125) and the bowler rolls the second ball at block 1123.

A determination is then made at block 1126 as to whether the mark type indicator is equal to 0 or 2. If the mark type indicator is equal to 2, the game is over (block 1118). If the mark type indicator is equal to 0, a determination is then made at block 1127 as to whether all the pins were knocked down. If so, the performance record is updated at 1128 to reflect the bowler's success at knocking down the pins of the pin configuration and the game is over (block 1118). If not, the performance record is updated at 1129 to reflect the bowler's failure at knocking down the pins of the pin configuration and the game is over (block 1118).

Of course, the performance record is not limited to storing pin configuration data regarding spare attempts. The performance record may in fact keep track of all rolls and the results thereof by a bowler.

In accordance with another aspect of the present invention, advertising is communicated to the bowler consoles from one or more remotely servers or personal computers. This advertising is output to the bowlers via displays and/or speakers. The advertising may be displayed in a full screen format, as an overlay, as a scrolling display, as a periodic display and the like. The advertising may be of a general nature or may be specifically targeted to bowlers. In one implementation, the bowler consoles access data from one or more remote advertiser computers based on a bowler's performance. In the case of advertising, for example, the performance data may be used by the advertiser to provide certain rewards such as discounts, free products, and the like. For example, an advertiser may give rewards to bowlers who bowl a perfect ("300") game, who bowl a certain number of pins over average for a particular game, who bowl a certain number of pins over average for a particular series, who make a particularly difficult split (e.g. the 7-10 split), who make a certain number of strikes in a row, and the like. Rewards may also be based on team performance. Thus, teams that bowl a certain number of pins over the combined averages of the team members for a game or for a series may be given certain rewards.

The remote advertiser computer(s) may also use the performance data to "challenge" a bowler. For example, the advertiser may offer a reward for making a strike on a particular ball. Thus, when it is a particular bowler's turn to bowl, the remote computer may communicate data that is used to generate a display advising the bowler that he/she will be given a certain reward if he/she makes a strike in this frame. In another example, pin configurations may be communicated to the advertiser. Thus, for example, the advertiser may offer a reward if a bowler makes a 7-10 split. More specifically, the pin configuration data is communicated from lane control system 104 via LAN 102 to a bowler console and then via WAN 114 to one of remote web servers 110 or one of remote personal computers 112. In response to this pin configuration data, the remote web server or personal computer transmits content (e.g., text and graphics including advertising) determined in accordance with the pin configuration data back to the bowler console. This content is then output via display(s) 426 and speaker(s) 428 to the bowler. The content may also be output to displays 120 via LAN 102 and lane control system 104.

The rewards may be based on a particular bowler's past performances as evidenced, for example, by the bowler's average. Thus, a bowler having a 150 average may be given certain rewards for achieving 5 strikes in a row, while a bowler with a 175 average may have to roll 7 strikes in a row to be given the same reward. Similarly, the bowler may be given rewards for making spares that are "difficult" for him/her based upon that bowler's prior success at making the same spares.

The rewards may also be tied to certain demographic data of the bowlers. In this case, bowlers who provide the advertiser with certain demographic data such as age, income and the like, thereby permitting more focused advertising, may be eligible for certain rewards that are not available to bowlers who do not provide this demographic data.

In one particular implementation, the rewards may be miles for frequent flier programs. Thus, a bowler may be rewarded with one or more frequent flier miles for each pin over average. The bowler may also be rewarded with a number of frequent filer miles for each strike and/or spare made, with bonuses for making stringing together two or more strikes and/or two or more spares. The number of frequent flier miles for a given spare may be determined based on the degree of difficult of making the spare, either relative to the particular bowler or relative to all bowlers.

Although the advertising feature is described above with respect to a connection to an advertiser's web site, the invention is not limited in this respect. That is, the proprietor of a particular establishment or "house" may make arrangements with advertisers whereby the advertiser can utilize system control computer 106 to provide advertising to bowlers.

The contents of any patent or technical documents mentioned above are hereby incorporated herein in their entirety.

While particular embodiments of the present invention have been described and illustrated, it should be understood that the invention is not limited thereto because modifications may be made by persons skilled in the art. The present application contemplates any and all modifications that fall within the spirit and scope of the underlying invention discloses and claimed herein.

I claim:

1. A lane control system comprising:

a control circuit which is in communication with a pinsetter for setting pins on a pin deck of a bowling lane and which is supplied with pinfall data; and a memory accessible by the control circuit for storing performance data of a bowler, wherein:

the control circuit, based on the pinfall data supplied thereto, determines whether the bowler knocks down all the pins of a pin configuration;

if the bowler fails to knock down all the pins of the pin configuration, the control circuit determines, using the bowler's stored performance data, whether to re-set the pin configuration; and if a determination is made to re-set the pin configuration, the control circuit controls the pinsetter to re-set the pin configuration on the pin deck.

2. The system according to claim 1, wherein the performance data comprises the bowler's scoring average.

3. The system according to claim 1, wherein the performance data comprises data indicative of the bowler's past successes and failures at knocking down pins arranged in the pin configuration.

4. The system according to claim 1, wherein the performance data comprises data indicative of the bowler's past successes and failures at knocking down pins arranged in the pin configuration relative to the successes and failures of one or more other bowlers at knocking down pins arranged in the same pin configuration.

5. The system according to claim 1, wherein the memory is a portable memory module.

6. The system according to claim 1, further comprising a communication circuit for, in use, accessing the memory via the Internet.

7. The system according to claim 1, wherein the control circuit controls the pinsetter to re-set the pin configuration on the pin deck a plurality of times.

8. The system according to claim 1, wherein the control circuit controls the pinsetter to repeatedly re-set the pin configuration on the pin deck until the bowler knocks down all the pins in a single roll.

9. The system according to claim 1, further comprising:

an automatic scoring system configured to maintain a score for the bowler that does not include the number of pins of the re-set pin configuration that are knocked down by the bowler.

10. The system according to claim 1, further comprising:

an automatic scoring system configured to maintain a first score for the bowler based on the number of pins knocked down prior to the re-setting of the pin configuration and to maintain a second score for the bowler based on the number of pins knocked down after the re-setting of the pin configuration.

11. The system according to claim 1, further comprising:

an automatic scoring system configured to maintain a single score and to permit the single score to be based on either the number of pins knocked down prior to the re-setting of the pin configuration or on the number of pins knocked down after the re-setting of the pin configuration.

12. The system according to claim 1, wherein the control circuit controls the pinsetter to re-set the pin configuration only if the pin configuration is one of a plurality of predetermined pin configurations.

13. A lane control method comprising:

accessing a computer-readable memory storing performance data of a bowler;

determining based on pinfall data whether the bowler knocks down all the pins of a pin configuration on a pin deck of a bowling lane;

if the bowler fails to knock down all the pins of the pin configuration, determining, using the bowler's stored performance data, whether to re-set the pin configuration; and if a determination is made to re-set the pin configuration, controlling a pinsetter to re-set the pin configuration on the pin deck.

14. The method according to claim 13, wherein the performance data comprises the bowler's scoring average.

15. The method according to claim 13, wherein the performance data comprises data indicative of the bowler's past successes and failures at knocking down pins arranged in the pin configuration.

16. The method according to claim 13, wherein the performance data comprises data indicative of the bowler's past successes and failures at knocking down pins arranged in the pin configuration relative to the successes and failures of one or more other bowlers at knocking down pins arranged in the same pin configuration.

17. The method according to claim 13, wherein the computer-readable memory is a portable memory module.

18. The method according to claim 13, further comprising connecting to the Internet to access the computer-readable memory.

19. The method according to claim 13, further comprising:

maintaining a score for the bowler based on the pins of the re-set pin configuration that are knocked down by the bowler.

20. The method according to claim 13, further comprising:

controlling the pinsetter to re-set the pin configuration on the pin deck a plurality of times.

21. The method according to claim 13, further comprising:

controlling the pinsetter to repeatedly re-set the pin configuration on the pin deck until the bowler knocks down all the pins of the pin configuration in a single roll.

22. A lane control system comprising:

a control circuit which is in communication with a pinsetter for setting pins on a pin deck of a bowling lane and which is supplied with pinfall data; and a memory accessible by the control circuit for storing performance data of a bowler, wherein:

the control circuit, based on the pinfall data supplied thereto, determines whether the bowler knocks down all the pins of a pin configuration;

if the bowler fails to knock down all the pins of the pin configuration, the control circuit determines, using the bowler's stored performance data, whether to re-set the pin configuration;

if a determination is made to re-set the pin configuration, the control circuit controls the pinsetter to re-set the pin configuration on the pin deck; and if the pin configuration is one of a plurality of predetermined pin configurations, the control circuit further controls the pinsetter to repeatedly re-set the pin configuration on the pin deck until the bowler knocks down all the pins in a single roll.

23. A lane control system comprising:

a control circuit which is in communication with a pinsetter for setting pins on a pin deck of a bowling lane and which is supplied with pinfall data; and a memory accessible by the control circuit for storing performance data of the bowler, wherein:

the control circuit, based on the pinfall data supplied thereto, determines whether the bowler knocks down all the pins of a pin configuration;

if the bowler fails to knock down all the pins of the pin configuration, the control circuit determines, using the bowler's stored performance data, whether to re-set the pin configuration; and if a determination is made to re-set the pin configuration, the control circuit controls the pinsetter to re-set the pin configuration on the pin deck, wherein the control circuit controls the pinsetter to repeatedly re-set the pin configuration on the pin deck until the bowler knocks down all the pins in a single roll, and wherein the control circuit generates display signals for a display informing the bowler that the pin configuration is being re-set.

24. The method according to claim 21, wherein the pin configuration is repeatedly reset only if the pin configuration is one of a plurality of predetermined pin configurations.

25. The method according to claim 13, further comprising:

providing a display informing the bowler that the pin configuration is being re-set.

26. A lane control system comprising:

a control circuit which is in communication with a pinsetter for setting pins on a pin deck of a bowling lane; and a memory accessible by the control circuit for storing performance data of the bowler, wherein the control circuit controls the pinsetter to set pin configurations on the pin deck based on performance data indicative of the bowler's past successes and failures at knocking down all the pins of various pin configurations.

27. The system according to claim 26, wherein the control circuit controls the pinsetter to re-set one or more of the pin configurations on the pin deck a plurality of times.

28. The system according to claim 26, wherein the control circuit controls the pinsetter to re-set one or more of the pin configurations on the pin deck until the bowler knocks down all the pins of those one or more pin configurations in a single roll.

29. The system according to claim 26, wherein the memory comprises a portable memory module.

* * * * *